US007159859B2

(12) United States Patent
Fuller

(10) Patent No.: US 7,159,859 B2
(45) Date of Patent: Jan. 9, 2007

(54) PIPE CLAMP WITH RELEASABLE CLAMP BODY

(75) Inventor: Anthony B. Fuller, Mooresville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 185 days.

(21) Appl. No.: 10/678,724

(22) Filed: Oct. 3, 2003

(65) Prior Publication Data

US 2005/0156368 A1 Jul. 21, 2005

(51) Int. Cl.
*B25B 5/02* (2006.01)

(52) U.S. Cl. ..... 269/170

(58) Field of Classification Search ..... 269/166–171.1, 269/197–199

See application file for complete search history.

(56) References Cited

U.S. PATENT DOCUMENTS

| | | | |
|---|---|---|---|
| 100,642 | A | 3/1870 | Lambert |
| 153,206 | A | 7/1874 | Van Wagoner |
| 226,617 | A | 4/1880 | Konig |
| 267,152 | A | 11/1882 | Cloud |
| 404,368 | A | 5/1889 | Stearns |
| 408,473 | A | 8/1889 | Focken |
| 410,815 | A | 9/1889 | Tarbell |
| 416,096 | A | 11/1889 | Dom |
| 491,633 | A | 2/1893 | Bourassa |
| 678,805 | A | 7/1901 | Weyand |
| 749,732 | A | 1/1904 | Hanson et al. |
| 757,166 | A | 4/1904 | Witsch, Jr. |
| 775,659 | A | 11/1904 | Jorgensen |
| 792,758 | A | 7/1905 | Colt |
| 927,067 | A | 7/1909 | Offineer |
| 934,589 | A | 9/1909 | Bradford |
| 1,241,215 | A | 9/1917 | Hoffman |
| 1,336,755 | A | 4/1920 | Parmelee |
| 1,340,092 | A | 5/1920 | Tuscher, Jr. |
| 1,393,766 | A | 10/1921 | Du Charme |
| 1,402,621 | A | 1/1922 | Knittel et al. |
| 1,450,940 | A | 4/1923 | Cobb |
| 1,452,753 | A | 4/1923 | Otto et al. |
| 1,583,611 | A | 5/1926 | Seely |
| 1,639,561 | A | 8/1927 | Hargrave |
| 1,783,713 | A | 12/1930 | Holman et al. |
| 1,811,518 | A | 6/1931 | Palmer |
| 1,890,042 | A | 12/1932 | Morandi |
| 2,133,892 | A | 10/1938 | Gelinski |
| 2,157,345 | A | 5/1939 | Nelson |
| 2,468,358 | A | 4/1949 | Clark |

(Continued)

FOREIGN PATENT DOCUMENTS

| | | |
|---|---|---|
| AU | 225561 | 11/1959 |

(Continued)

OTHER PUBLICATIONS

"Pony Steel Bar Clamp Fixtures" styles 50, 52 and 56. Publication source and date unknown. One page. It is believed that this publication was available to the public prior to Oct. 3, 2002.

(Continued)

*Primary Examiner*—Robert C. Watson
(74) *Attorney, Agent, or Firm*—Dennis J. Williamson; Moore & Van Allen PLLC

(57) ABSTRACT

A clamp body is provided with a channel formed in the clamp body and a retainer is movably mounted in the clamp body. A jaw is mounted on the clamp body and an end cap blocking one end of the channel.

12 Claims, 7 Drawing Sheets

U.S. PATENT DOCUMENTS

| | | | | |
|---|---|---|---|---|
| 2,656,864 | A | | 10/1953 | Hopfeld |
| 2,781,803 | A | | 2/1957 | Nelson |
| 2,815,778 | A | | 2/1957 | Holman |
| 2,815,053 | A | | 12/1957 | Walker |
| 2,923,334 | A | | 2/1960 | Brennan, Jr. |
| 2,949,947 | A | | 8/1960 | Story |
| 3,033,559 | A | | 5/1962 | Lindholm |
| 3,159,393 | A | | 12/1964 | Villano |
| 3,173,674 | A | | 3/1965 | Ringle |
| 3,218,058 | A | * | 11/1965 | Smith ..... 269/166 |
| 3,331,111 | A | | 7/1967 | Carver |
| 3,499,206 | A | | 3/1970 | Quernheim |
| 3,575,405 | A | | 4/1971 | Harding |
| 3,596,898 | A | | 8/1971 | Hilburn |
| D222,872 | S | | 1/1972 | Boucher |
| D227,192 | S | | 6/1973 | Schafhauser |
| 3,806,107 | A | | 4/1974 | Pitzer et al. |
| 3,914,890 | A | | 10/1975 | Bolton |
| D238,140 | S | | 12/1975 | Guimarin |
| 3,933,346 | A | | 1/1976 | Carver |
| 3,963,230 | A | | 6/1976 | Jankowski, Jr. |
| 4,078,781 | A | | 3/1978 | Fraser et al. |
| 4,083,548 | A | | 4/1978 | Hackbarth |
| 4,088,313 | A | | 5/1978 | Pearson |
| 4,132,397 | A | | 1/1979 | Ward |
| 4,143,869 | A | | 3/1979 | Paterson et al. |
| D259,327 | S | | 5/1981 | Sloane |
| 4,306,710 | A | | 12/1981 | Vosper |
| 4,339,113 | A | | 7/1982 | Vosper |
| 4,381,105 | A | | 4/1983 | Goff et al. |
| 4,563,921 | A | | 1/1986 | Wallace |
| D286,369 | S | | 10/1986 | Hahn |
| 4,874,155 | A | | 10/1989 | Goul |
| 4,893,801 | A | | 1/1990 | Flinn |
| 4,926,722 | A | | 5/1990 | Sorensen et al. |
| 4,989,847 | A | | 2/1991 | Chapman |
| 5,009,134 | A | | 4/1991 | Sorensen et al. |
| 5,058,870 | A | | 10/1991 | Cetnar |
| 5,064,178 | A | | 11/1991 | Nimtz |
| 5,094,131 | A | | 3/1992 | Sorensen et al. |
| 5,096,170 | A | | 3/1992 | Albin |
| 5,156,508 | A | | 10/1992 | Grisley |
| 5,161,787 | A | | 11/1992 | Hobday |
| D333,963 | S | | 3/1993 | Goodman |
| 5,197,360 | A | | 3/1993 | Wooster, Jr. |
| 5,222,420 | A | | 6/1993 | Sorensen et al. |
| D340,632 | S | | 10/1993 | Easley |
| D346,942 | S | | 5/1994 | Sawdon |
| 5,346,194 | A | | 9/1994 | Coffin, III |
| D355,104 | S | | 2/1995 | Sorensen et al. |
| 5,443,246 | A | * | 8/1995 | Peterson ..... 269/166 |
| 5,454,551 | A | | 10/1995 | Hobday |
| D365,263 | S | | 12/1995 | Sorensen et al. |
| 5,692,734 | A | | 12/1997 | Aldredge, Sr. |
| 5,775,680 | A | * | 7/1998 | Sorensen et al. ..... 269/170 |
| 2001/0006270 | A1 | | 7/2001 | Baculy |

FOREIGN PATENT DOCUMENTS

| | | | |
|---|---|---|---|
| DE | 25 39 613 | A1 | 3/1977 |
| DE | 33 47 232 | A1 | 7/1985 |
| DE | 87 05 546.5 | U1 | 7/1987 |
| EP | 0274 746 | A1 | 7/1988 |
| FR | 1019277 | | 1/1953 |
| TW | 54742 | | 6/1990 |

OTHER PUBLICATIONS

Bessey Steel Bar Clamp Fixture RS 75 instructions. Publication source and date unknown. Two pages. It is believed that this publication was available to the public prior to Oct. 3, 2002.

Advertisement for Bessey Bar Clamps Styles 52, 53 and 56. Publication source and date unknown. One page. It is believed that this publication was available to the public prior to Oct. 3, 2002.

Advertisement for Gross Stabil Clamp and Bessey Bar Clamps Styles 43 and 45. Publication source and date unknown. One page. It is believed that this publication was available to the public prior to Oct. 3, 2002.

"Pony Clamp Fixtures" styles 50, 52, 53 and 56. "Jorgensen Style 3500 Aluminum Bar Clamps." "Jorgensen Style 7200 Steel I-Bar Clamps." Publication source and date unknown. One page. It is believed that this publication was available to the public prior to Oct. 3, 2002.

"Enco Precision Ground Milling Machine Vises" Publication source and date unknown. Two pages. It is believed that this publication was available to the public prior to Oct. 3, 2002.

"Handy Quick Clamp Manual" Publication source and date unknown. Four pages. It is believed that this publication was available to the public prior to Oct. 3, 2002.

PCT International Search Report for PCT/US04/32166 dated Mar. 28, 2006.

PCT International Preliminary Report on Patentability dated May 4, 2006.

* cited by examiner

PIPE CLAMP WITH RELEASABLE CLAMP BODY

BACKGROUND OF THE INVENTION

1. Field of Invention

The present invention relates to clamps such as pipe clamps, and in particular to pipe clamps having a releasably attached clamp body restraining motion of the support past the end of the clamp body.

2. Discussion of Related Art

Clamps such as bar clamps and pipe clamps have been widely used in a variety of forms. For example, U.S. Pat. No. 5,775,680 to Sorensen et al., the entire contents of which are incorporated herein by reference, discloses a bar clamp with a retainer within a clamp body through which a threaded screw is fed.

EP0274746A1 to Kloepfer et al. discloses a clamp with a jaw that has a spring-loaded tilt plate for securing a displaceably mounted jaw against a rail.

Neither of the above described references addresses the problem solved by the present invention, namely the need for a releasable clamp body that is restrained against motion past the end of a bar, pipe, or support.

BRIEF SUMMARY OF THE INVENTION

One aspect of the present invention regards a clamp that includes a support having a first end and a second end and defining a support axis. A workpiece supporting element is mounted to the support and a clamp body releasably connected to the support through a channel formed in the clamp body wherein the first end is inserted into the channel. The clamp body includes a retainer movably mounted to the clamp body to engage the support selectively and thereby to hold the clamp body selectively against movement with respect to the support in at least a first direction along the support axis. The clamp body further includes a jaw mounted on the clamp body and opposing the workpiece supporting element and an end cap opposite the jaw on the clamp body wherein the clamp body is restrained from motion along the support axis towards the workpiece supporting element beyond the first end of the support.

In another aspect of the present invention, a clamp body is provided with a channel formed in the clamp body and a retainer is movably mounted in the clamp body. A jaw is mounted on the clamp body and an end cap blocking one end of the channel.

A third aspect of the present invention regards a method for orienting a clamp body with respect to a support of a clamp. The method includes providing a clamp body and support unattached to one another and placing a retainer in the clamp body in a release position by depressing the retainer. Placing a channel of the clamp body and a first end of the support in substantial alignment, inserting the clamp body onto the support until the first end impinges on an end cap of the clamp body and placing the retainer in an inclined position by releasing the retainer so that the clamp body is attached to the support.

A fourth aspect of the present invention regards a method for orienting a clamp body with respect to a support of a clamp by providing a support with a clamp body secured to the support. The method further includes placing a retainer in the clamp body in a release position by depressing the retainer. At the release position, the clamp body is moved in a first direction along the support but is prevented from moving in a direction opposite the first direction. Next, the clamp body is removed from the support.

DETAILED DESCRIPTION OF THE PREFERRED EMBODIMENTS

Figure 1:
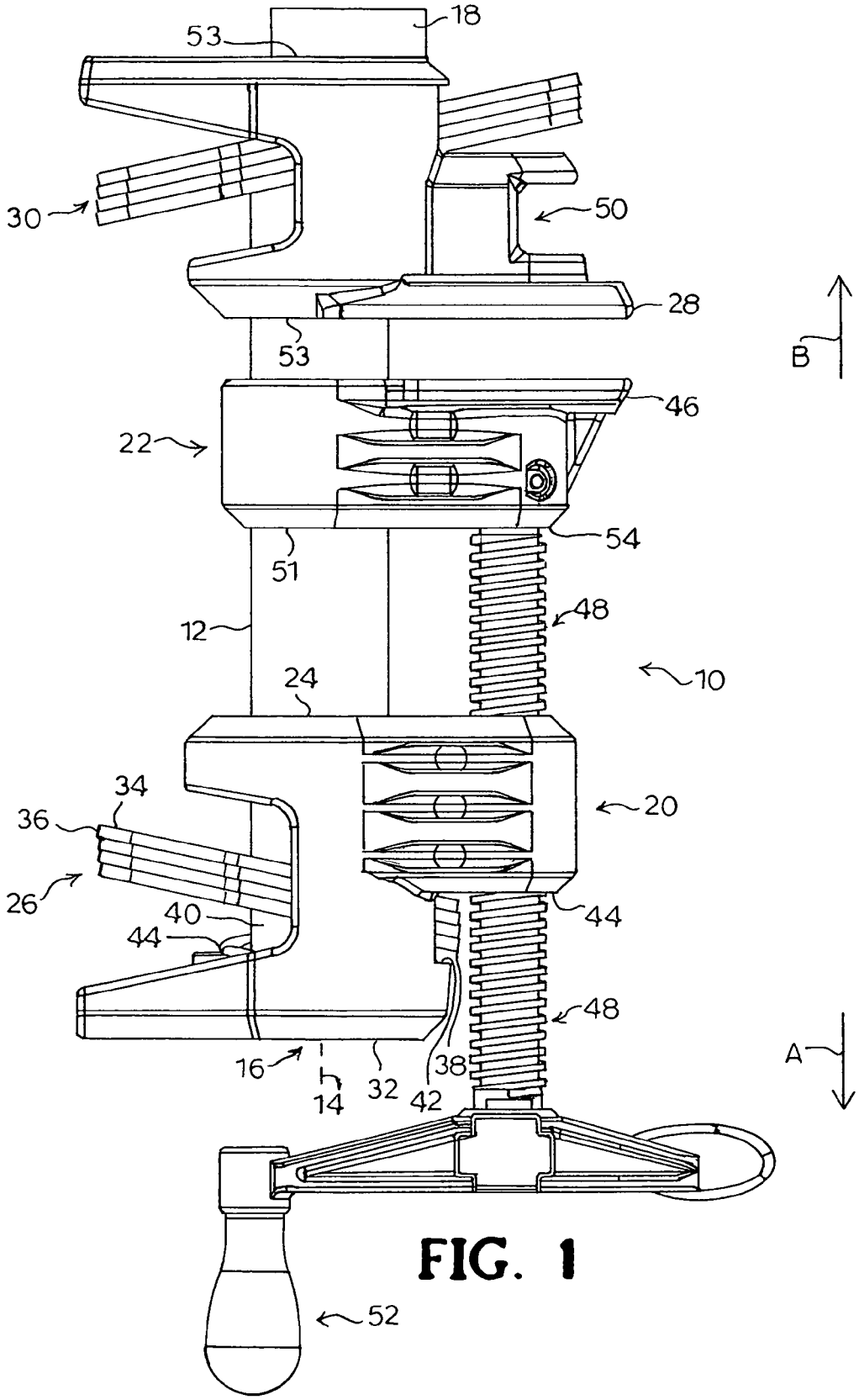
FIG. 1 is a right side view of a first embodiment of a pipe clamp with a retainer in an inclined position in accordance with the present invention.

In the drawings, FIG. 1 shows an overall view of a clamp, such as a pipe clamp 10 which incorporates a first preferred embodiment of the present invention. The pipe clamp 10 includes a support 12 defining a support axis 14 and having a first end 16 and a second end 18. The support 12 may have different cross-sectional shapes, such as an annulus if it is a pipe or a rectangle if it is a bar. Three components are slidably mounted on the support 12: a clamp body 20, a workpiece supporting element 22, and a workpiece-engaging element 50. The clamp body 20 is releasably connected to the support 12 through a channel 24 formed in the clamp body. The first end 16 of the support 12 is inserted into the channel 24 of the clamp body 20.

A retainer 26 is mounted to the clamp body 20 to engage the support 12 selectively and to hold the clamp body 20 selectively against movement with respect to the support 12 in at least a first direction A along the support axis 14. An end cap 32 is present at an end of the clamp body 20 nearest the handle 52.

Figure 2:
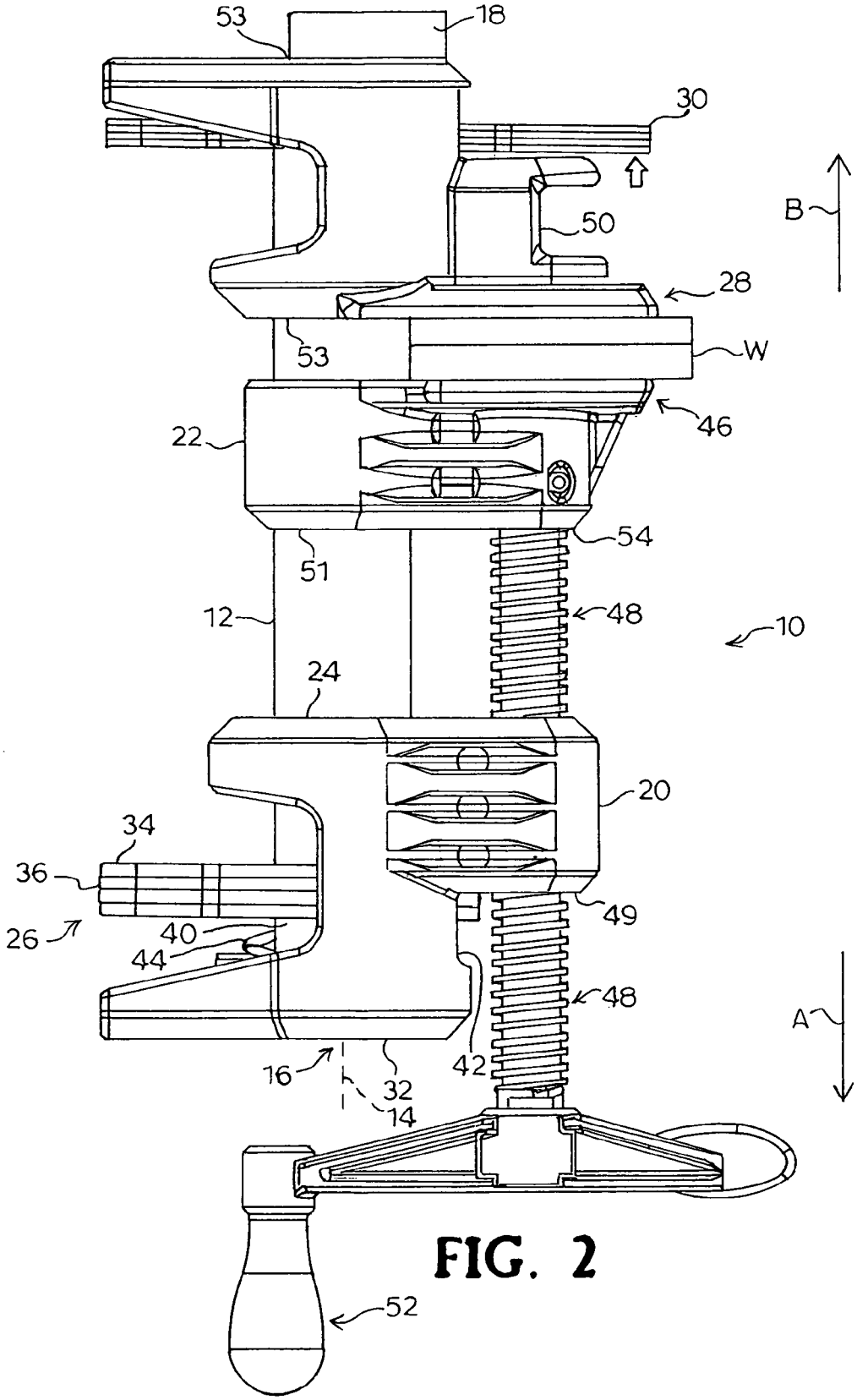
FIG. 2 is a right side view of the pipe clamp of FIG. 1 with the retainer in a release position.
Figure 3A:
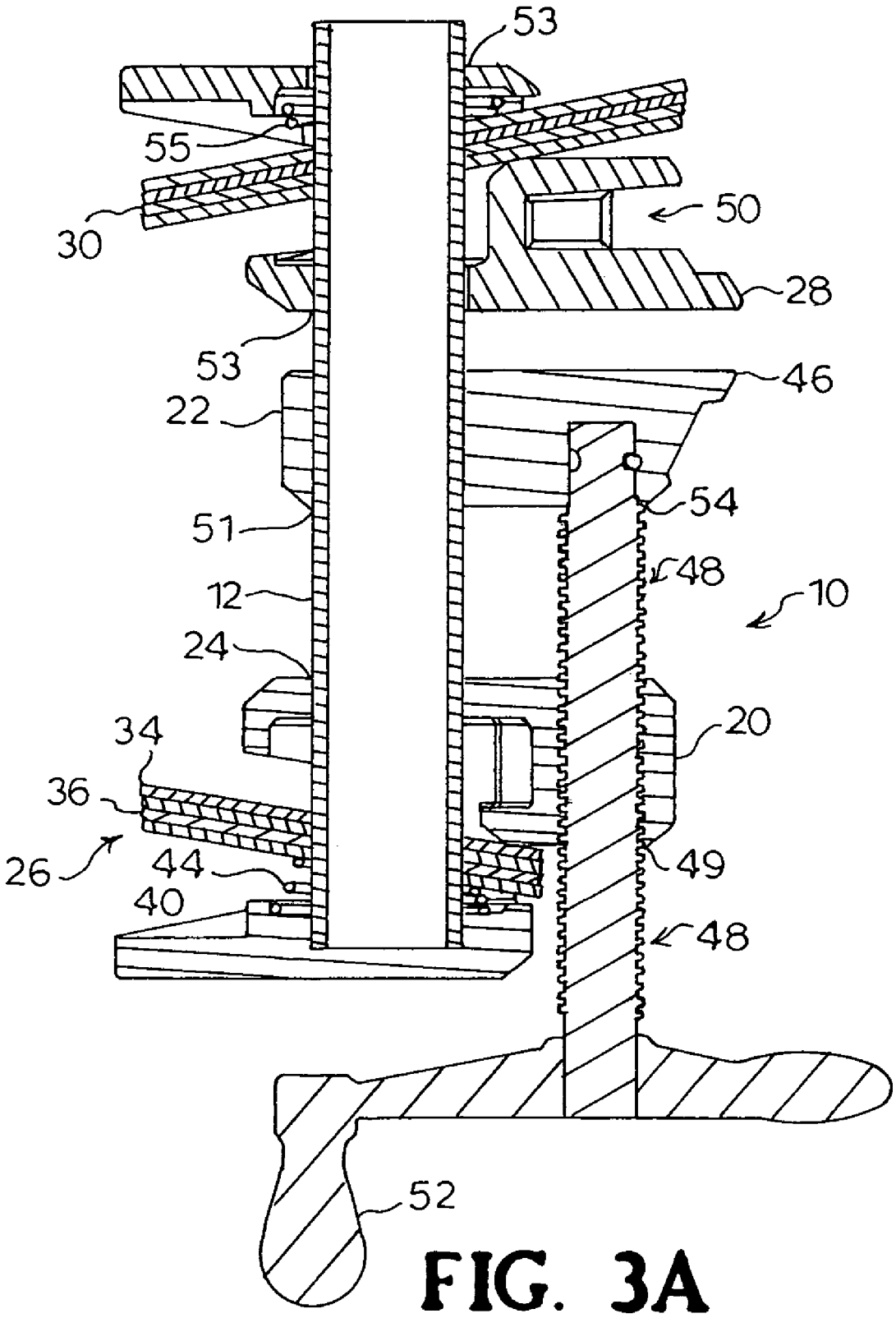
FIG. 3A is a right side cross-sectional view of the clamp in FIG. 1 with the retainer in the inclined position.
Figure 3B:
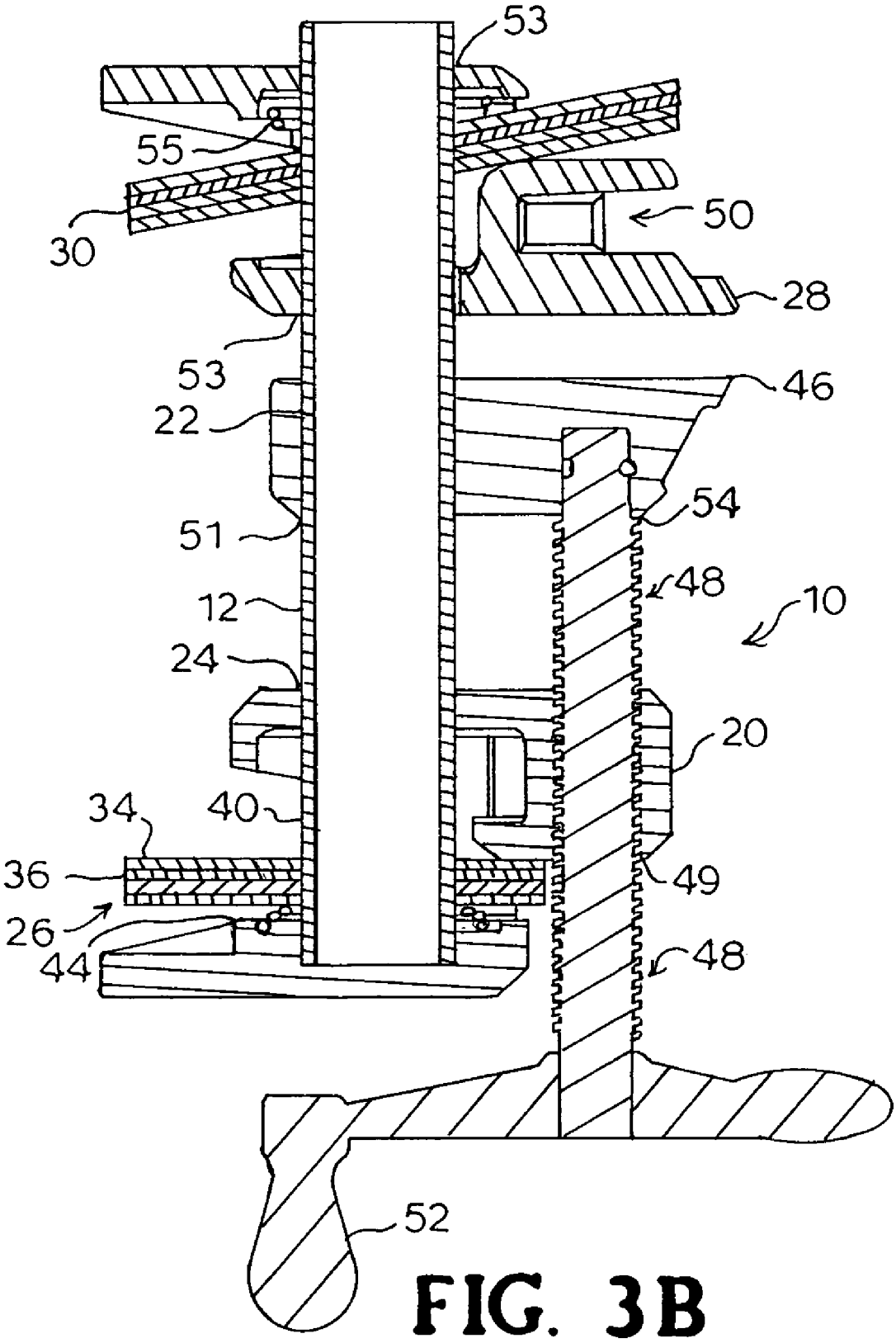
FIG. 3B is a right side cross-sectional view of the clamp in FIG. 2 with the retainer in the inclined position.
Figure 4:
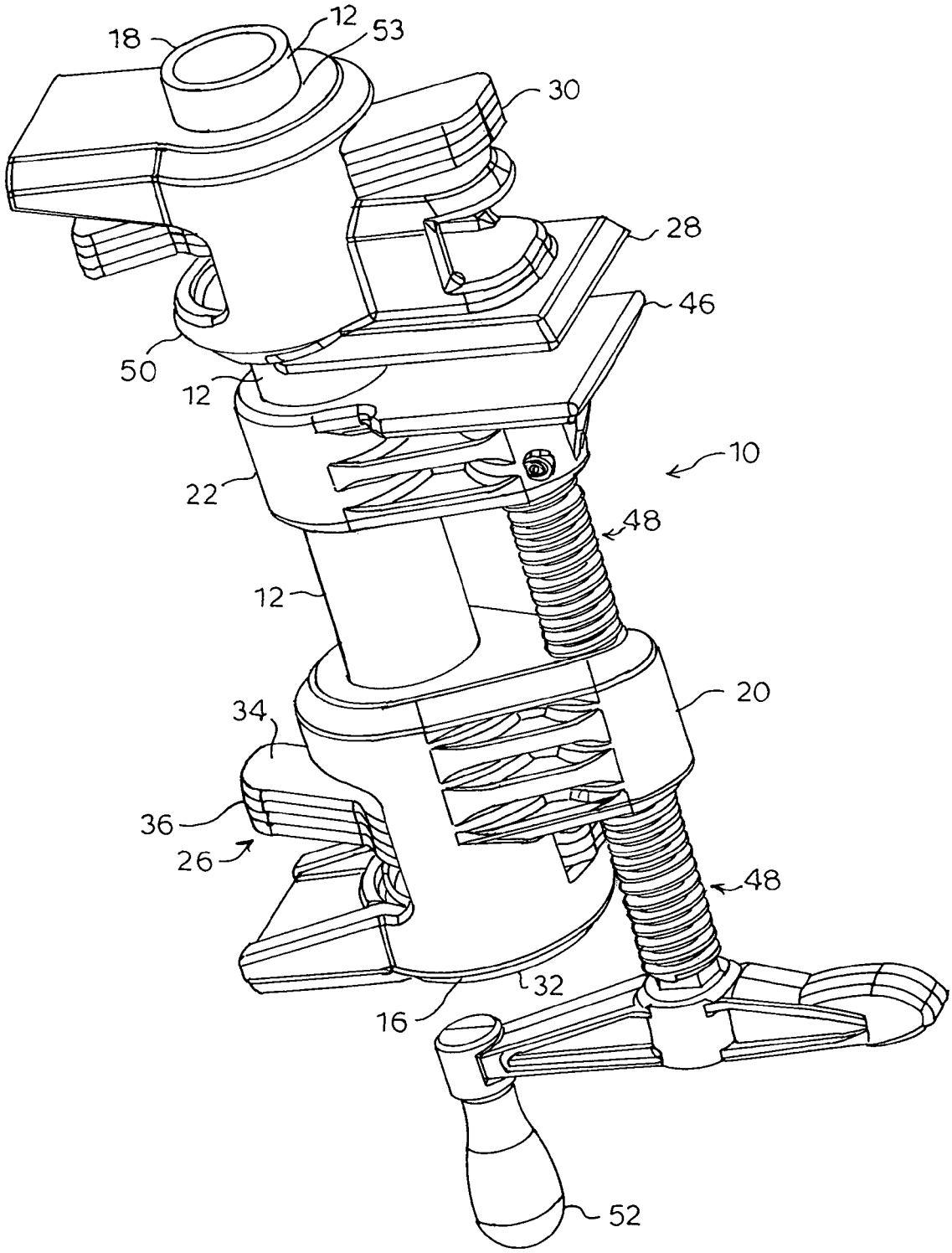
FIG. 4 is a right side perspective view of the clamp in FIG. 1.
Figure 5:
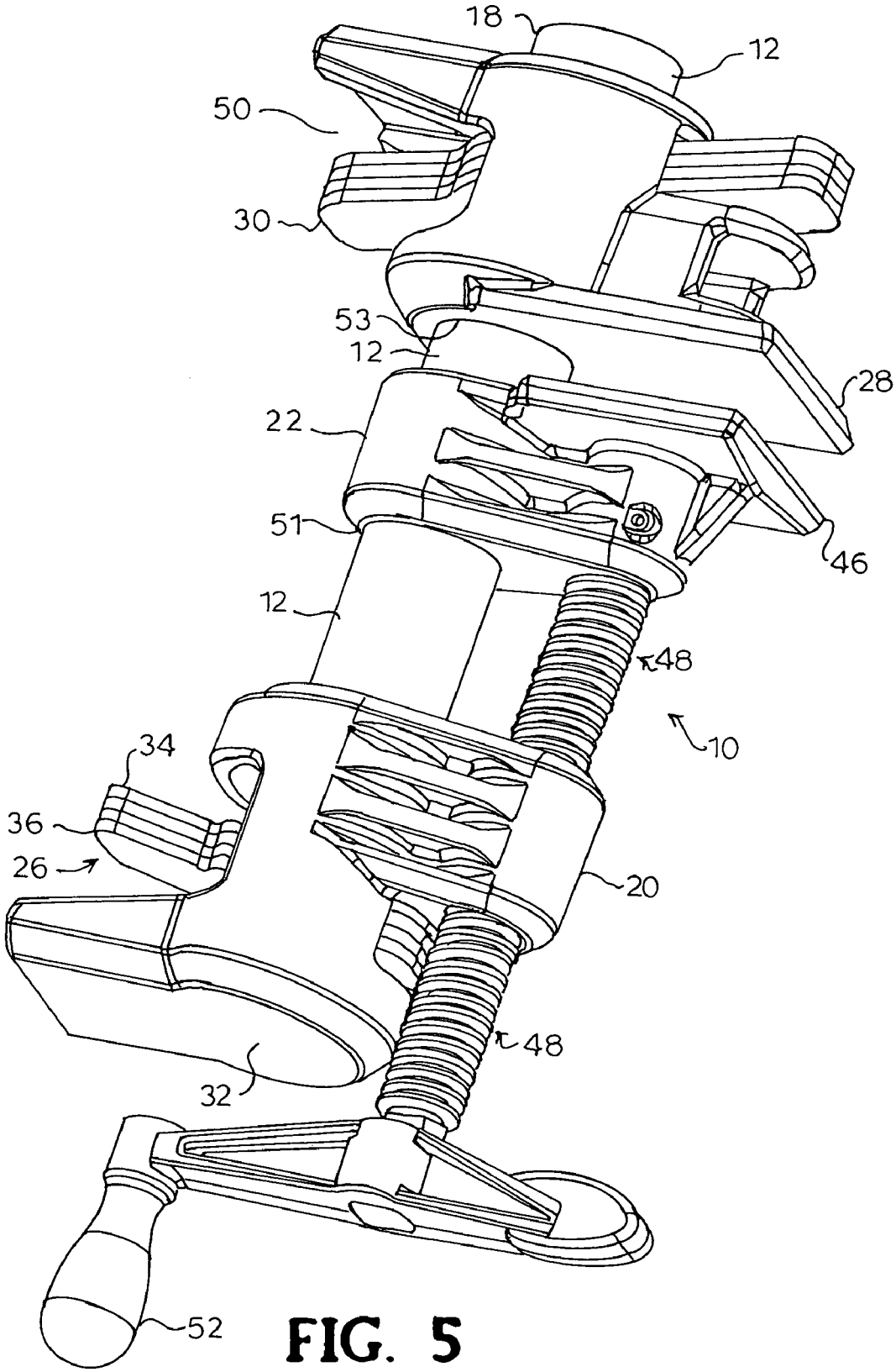
FIG. 5 is a second right side perspective view of the clamp in FIG. 1.
Figure 6:
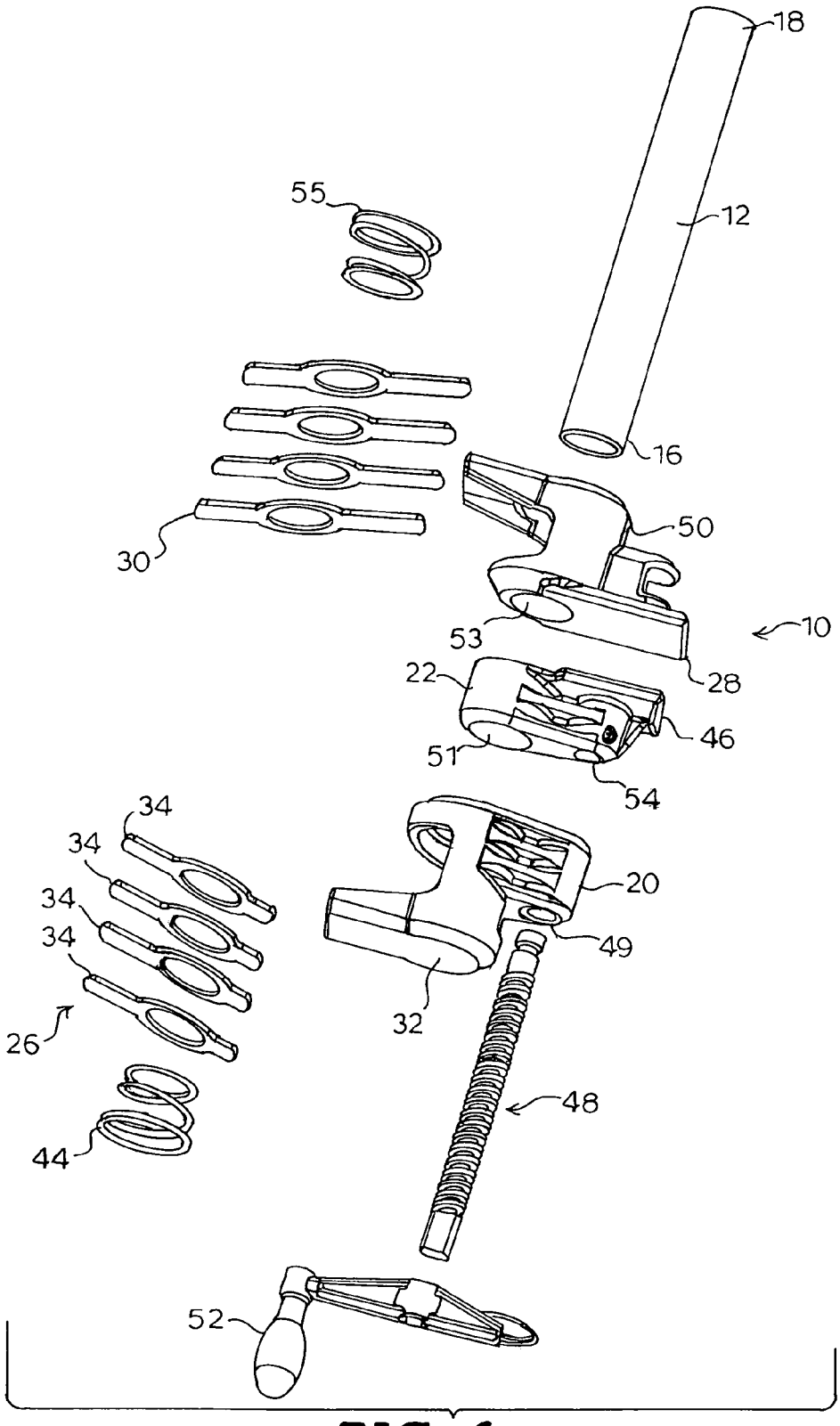
FIG. 6 is an exploded view of the clamp in FIG. 1.

Note that the retainer 26 may be embodied as one or more tabs 34 positioned around the support 12. Each tab 34 includes a closed opening that generally corresponds to the cross-sectional shape of the support 12. Each tab 34 is contained within clamp body 20 and has two ends 36 and 38 that extend through side openings 40 and 42 of the clamp body 20. The tabs 34 are coupled to the clamp body 20 by a spring mechanism 44 (also see FIGS. 3A–B) which is partially compressed when the retainer 26 is in the inclined position (in which the retainer 26 holds the clamp body 20 against movement along direction A with respect to the support 12 while allowing movement along direction B shown in FIG. 1), and fully compressed when the retainer is in the release position (in which the retainer 26 accommodates movement of the clamp body 20 with respect to the support 12 along both directions A and B) as shown in FIG. 2. The spring mechanism 44 preferably is a helical spring that has its longitudinal axis coinciding with the axis 14. One end of the spring 44 contacts the interior wall of the end cap 32 while the other end of the spring contacts the retainer 26.

As shown in FIGS. 1–5, the clamp body 20 is attached to the workpiece supporting element 22 via a screw 48. A portion of the screw 48 threadedly engages a threaded opening 49 of the clamp body. One end of the screw 48 is attached to a handle 52 while the other end of the screw 48 is connected to the workpiece supporting element 22 in a well known manner such as described in U.S. Pat. No. 5,775,680, the entire contents of which are incorporated herein by reference. In particular, the end of the screw 48 is inserted into an unthreaded opening 54 of the workpiece supporting element 22.

As shown in FIGS. 1–6, the workpiece supporting element 22 includes a second non–threaded opening 51 into which the support 12 is inserted. The workpiece supporting element 22 further includes a jaw 46 mounted thereon that faces an opposing jaw 28 of the workpiece engaging element 50.

The workpiece engaging element 50 operates in a manner similar to a like element disclosed in U.S. Pat. No. 5,775,680. In particular, the workpiece engaging element 50 includes a channel 53 that allows the support 12 to be inserted therethrough so that end 18 extends past the channel 53. A spring mechanism, such as the helical spring 55, is positioned within the workpiece engaging element 50 so that its longitudinal axis coincides with axis 14. One end of the spring 55 contacts the interior wall of the distal end of the workpiece engaging element 50 while the other end of the spring contacts the retainer 30. The retainer 30, which includes tabs like tabs 34, is biased by a spring 55 to engage the support 12 in a known manner. For example, when the spring 55 is partially compressed the retainer 30 is in the inclined position shown in FIG. 1, the retainer 30 prevents the workpiece engaging element 50 from movement along direction B with respect to the support 12 while at the same time allowing movement along direction A. When the spring 55 is fully compressed the retainer 30 moves to the release position shown in FIG. 2 and allows the workpiece engaging element 50 to move along both directions A and B with respect to the support 12.

A method for attaching and removing a clamp body 20 to a support 12 and a method of clamping a workpiece is understood upon a review of FIGS. 1 and 2. For example, suppose the support 12 is unattached to either of the clamp body 20, the workpiece supporting element 22 and the workpiece engaging element 50. In this case, the workpiece engaging element 50 is attached to the support 12 near end 18 in a well known manner. Next, the end 16 of the support 12 is inserted through the opening 51 of the workpiece supporting element 22 and approaches the clamp body 20. Prior to the end 16 reaching the clamp body 20, the retainer 26 is depressed until the retainer 26 is in a horizontal release position by depressing the retainer 26 (indicated by the arrow in FIG. 2). Note that the retainer 26 may optionally not be depressed and be in the inclined position shown in FIG. 1. Next, the channel 24 of the clamp body 20 and the first end 16 of the support 12 are placed in substantial alignment. The clamp body 20 is inserted onto the support 12 until the first end 16 impinges on an end cap 32 of the clamp body 20. At this stage, the retainer 26 is placed in an inclined position (see FIG. 1) by releasing the retainer 26 so that the clamp body 20 is attached to the support 12. At this position, the end cap 32 prevents the clamp body 20 from substantially moving along direction B while the retainer 26 prevents the clamp body 20 from moving along direction A.

It should be understood that the above described attachment process is but one of many variations possible. For example, the clamp body 20 and the workpiece supporting element 22 can be attached to the support 12 prior to attachment of the workpiece engaging element 50 to the support 12.

Once the clamp body 20, workpiece supporting element 22 and the workpiece engaging element 50 are attached to the support 12, a workpiece W is placed against the jaw 28 of the workpiece engaging element 50. The workpiece supporting element 22 is then moved along the support 12 towards the workpiece W by actuating the handle 52 of the screw 48 until the jaw 46 contacts the workpiece W. At this position, the workpiece W is held between the jaw 28 of the workpiece engaging element 50 and the jaw 46 of the workpiece supporting element 22.

The workpiece W is unclamped in three possible ways. First, the retainer 30 is moved to its horizontal release position as shown in FIG. 2 and the workpiece engaging element 50 is moved along direction B so that jaw 28 no longer contacts workpiece W. Second, the handle 52 is turned so that workpiece supporting element 22 and its jaw 46 move along direction A so that the jaw 46 no longer contacts workpiece W. Third, the retainer 26 is moved to its horizontal release position as shown in FIG. 2 and the clamp body 20 and the workpiece supporting element 22 move in unison along direction A so that jaw 46 no longer contacts workpiece W. In the latter scenario, the clamp body 20 and workpiece supporting element 22 are removed from the support 12 by continuing movement along direction A until end 16 is removed from the openings of the clamp body 20 and the workpiece supporting element 22.

Within the scope of the present invention, further embodiment variations of course also exist besides the explained example. For example, the present invention can be used in a variety of bar clamps including pipe clamps. Furthermore, the workpiece supporting element 22 and the screw 48 can be removed and the jaw can be attached to the clamp body 20. In this scenario, the clamp body is slid along the support 12 so as to have the jaw of the clamp body engage the workpiece.

I claim:

1. A clamp comprising:

a support comprising a first end and a second end and defining a support axis;

a workpiece engaging element mounted to the support;

a clamp body releasably connected to the support through a channel formed in the clamp body wherein the first end is inserted into the channel, the clamp body comprising:

a jaw operatively connected to the clamp body and opposing the workpiece engaging element;

a retainer movably mounted to the clamp body to engage the support selectively and thereby to hold the clamp body selectively against movement with respect to the support in at least a first direction along the support axis; and an end cap opposite the jaw on the clamp body wherein the clamp body is restrained from motion along the support axis towards the workpiece supporting element beyond the first end of the support.

2. The clamp in claim 1 wherein the retainer comprises a tab positioned around the support, coupled to the clamp body, and movable between an inclined position, in which the retainer holds the clamp body against movement in at least the first direction with respect to the support, and a release position, in which the retainer accommodates movement of the clamp body in the first direction with respect to the support.

3. The clamp in claim 1 wherein the retainer is coupled to the clamp body by a spring mechanism which is partially compressed when the retainer is the inclined position, and fully compressed when the retainer is in the release position.

4. The clamp body in claim 1 wherein the retainer comprises a tab coupled to the clamp body, and movable between an inclined position and a release position.

5. The clamp body in claim 4 wherein the retainer is coupled to the clamp body by a spring mechanism which is partially compressed when the retainer is the inclined position, and fully compressed when the retainer is in the release position.

6. The clamp in claim 1 wherein the jaw is supported on a workpiece supporting element, the clamp body being connected to the workpiece supporting element by a screw.

7. The clamp in claim 1 wherein the jaw is supported on a workpiece supporting element, the workpiece supporting element being movable relative to the clamp body.

8. The clamp in claim 1 wherein the workpiece engaging element is movably supported on the support.

9. The clamp in claim 1 further including a second retainer movably mounted to the workpiece engaging element to engage the support selectively and thereby to hold the workpiece engaging element selectively against movement with respect to the support in at least one direction along the support axis.

10. The clamp in claim 9 wherein the second retainer comprises a tab positioned around the support, coupled to the workpiece engaging element, and movable between an inclined position, in which the second retainer holds the workpiece engaging element against movement in at least one direction with respect to the support, and a release position, in which the retainer accommodates movement of the workpiece engaging element in the one direction with respect to the support.

11. The clamp in claim 10 wherein the second retainer is coupled to the workpiece engaging element by a second spring mechanism which is partially compressed when the second retainer is the inclined position, and fully compressed when the retainer is in the release position.

12. The clamp in claim 6 wherein rotation of the screw moves the workpiece supporting element relative to the screw.

* * * * *